US008083519B2

(12) United States Patent
Douglas

(10) Patent No.: US 8,083,519 B2
(45) **Date of Patent: *Dec. 27, 2011**

(54) BURNER NOZZLE

(75) Inventor: Steven L Douglas, Terre Haute, IN (US)

(73) Assignee: ConocoPhillips Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/168,732

(22) Filed: Jun. 24, 2011

(65) Prior Publication Data

US 2011/0256489 A1 Oct. 20, 2011

Related U.S. Application Data

(62) Division of application No. 11/846,238, filed on Aug. 28, 2007, now Pat. No. 7,993,131.

(51) Int. Cl.
*B05B 15/08* (2006.01)
*C23C 4/12* (2006.01)

(52) U.S. Cl. ..... 431/160; 110/235; 239/397; 431/154; 431/158

(58) Field of Classification Search ..... 431/160, 431/131, 154, 158; 239/397; 110/235
See application file for complete search history.

(56) References Cited

U.S. PATENT DOCUMENTS 2,960,594 A * 11/1960 Thorpe ..... 219/75
4,123,007 A * 10/1978 Gardner ..... 239/414
4,363,443 A * 12/1982 Huehne ..... 239/79
4,445,021 A * 4/1984 Irons et al. ..... 219/121.48
4,688,722 A * 8/1987 Dellassio et al. ..... 239/81
4,857,075 A * 8/1989 Lipp ..... 48/86 R
4,967,956 A * 11/1990 Mansfield ..... 239/9
5,834,066 A * 11/1998 Kunzli et al. ..... 427/446

* cited by examiner

*Primary Examiner* — Steven B McAllister
*Assistant Examiner* — Nikhil Mashruwala

(57) ABSTRACT

A burner comprises a body, a nozzle, and at least one attachment element for removably attaching the nozzle to the body. The body defines an oxidant inlet, a feedstock inlet, a body outlet, and one or more passages for conveying the oxidant from the oxidant inlet to the body outlet and for conveying the gasification feedstock from the feedstock inlet to the body outlet. The nozzle defines a nozzle inlet and a nozzle outlet, wherein the nozzle inlet is configured to receive the oxidant and the gasification feedstock from the body outlet and the nozzle outlet is configured to discharge the oxidant and the gasification feedstock into the reaction chamber. The at least one attachment element removably attaches the nozzle to the body such that the nozzle inlet is in fluid flow communication with the body outlet when the nozzle is attached to the body.

17 Claims, 8 Drawing Sheets

BURNER NOZZLE

CROSS-REFERENCE TO RELATED APPLICATION

This Application is a Divisional Patent Application of U.S. patent application Ser. No. 11/846,238, filed Aug. 28, 2007.

BACKGROUND

1. Field

The present technology relates to high-temperature burners. More particularly, various embodiments of the technology involve high-temperature burners with detachable nozzles for use with gasification reactors.

2. Related Art

Gasification reactors are used to convert generally solid feedstock into gaseous products. For example, gasifiers may gasify carbonaceous feedstock, such as coal and/or petroleum coke, to produce desirable gaseous products such as hydrogen. Gasification reactors include one or more burners for conveying oxidants and feedstocks to a reaction chamber, where combustion takes place at temperatures that may reach 2600° Fahrenheit or more.

Each burner includes a body and a nozzle. Because the nozzle is exposed to the heat and turbulence of the reaction chamber, the nozzle is typically the first part of the burner to degrade or wear out, and may wear out long before other parts of the burner. When the nozzle degrades to the point of failure, the burner must be repaired. Repair of the burner involves removing the burner from the gasification reactor or other system of which it is a part and refurbishing the burner. Both removing and refurbishing the burner can be quite involved. For example, removing the burner involves cutting or otherwise detaching various feed lines, including oxidant lines and feedstock lines, and physically removing the burner from the gasification reactor. Refurbishing the burner is also typically very involved. Because of the tools and the skills required to refurbish the burner, the burner may need to be shipped to an external facility that specializes in such repair work.

Because of the size of the burner, handling and shipping the burner can be an expensive and time-consuming process. Thus, the time required to refurbish a burner can be several months. In some applications, the time required to refurbish each burner may necessitate maintaining multiple burners in inventory in the event that a burner should fail before a second burner has been refurbished.

SUMMARY

The embodiments of the present technology provide a high-temperature burner with a removable nozzle that may be replaced on-site and without refurbishing the entire burner.

A first embodiment of the invention is a burner for conveying an oxidant and a gasification feedstock to a reaction chamber. The burner comprises a body, a nozzle, and at least one attachment element for removably attaching the nozzle to the body. The body defines an oxidant inlet, a feedstock inlet, a body outlet, and one or more passages for conveying the oxidant from the oxidant inlet to the body outlet and for conveying the gasification feedstock from the feedstock inlet to the body outlet. The nozzle defines a nozzle inlet and a nozzle outlet, wherein the nozzle inlet is configured to receive the oxidant and the gasification feedstock from the body outlet and the nozzle outlet is configured to discharge the oxidant and the gasification feedstock into the reaction chamber. The at least one attachment element removably attaches the nozzle to the body such that the nozzle inlet is in fluid flow communication with the body outlet when the nozzle is attached to the body.

A second embodiment of the invention is a burner comprising a body, a nozzle, and at least one bolt for removably attaching the nozzle to the body. The body includes a body inlet, a body outlet, a body passage interconnecting the body inlet and the body outlet, a body flange located proximate the body outlet, and a body coolant conduit. The nozzle includes a nozzle inlet, a nozzle outlet, a nozzle passage interconnecting the nozzle inlet and the nozzle outlet, a generally frustoconically shaped cooling jacket comprising at least one nozzle coolant conduit, wherein the cooling jacket at least partially surrounds at least a portion of the nozzle passage, and a nozzle flange extending radially outwardly from the cooling jacket. The at least one bolt removably attaches the nozzle flange to the body flange, wherein the body outlet is in fluid communication with the nozzle inlet and the body coolant conduit is in fluid communication with the nozzle coolant conduit when the nozzle is attached to the body.

A third embodiment of the invention is a gasification reactor system for gasifying a feedstock. The gasification reactor system comprises a first stage reactor section defining a first reaction zone, wherein the first stage reactor section comprises a plurality of inlets operable to discharge the feedstock into the reaction zone, and a burner disposed in each of the inlets. Each burner comprises a burner body defining a body inlet, a body outlet, and a body passage for providing fluid communication between the body inlet and the body outlet, a burner nozzle defining a nozzle inlet, a nozzle outlet, and a nozzle passage for providing fluid communication between the nozzle inlet and the nozzle outlet, wherein the open area of the nozzle inlet is greater than the open area of the nozzle outlet, and at least one attachment component for removably attaching the burner nozzle to the burner body such that the burner nozzle inlet is in fluid communication with the burner body outlet. The gasification reactor system further comprises a second stage reactor section positioned generally above the first stage reactor section and defining a second reaction zone.

A fourth embodiment of the invention is a method of replacing a nozzle of a gasification burner. The method comprises decoupling the gasification burner from a gasification reactor, decoupling the nozzle from a body of the gasification burner by removing one or more original bolts from the gasification burner, coupling a new nozzle to the body using one or more replacement bolts and/or the one or more original bolts, thereby providing a refurbished gasification burner, and coupling the refurbished gasification burner to the gasification reactor.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

Preferred implementations of the present technology are described in detail below with reference to the attached drawing figures, wherein.

DETAILED DESCRIPTION

Figure 1:
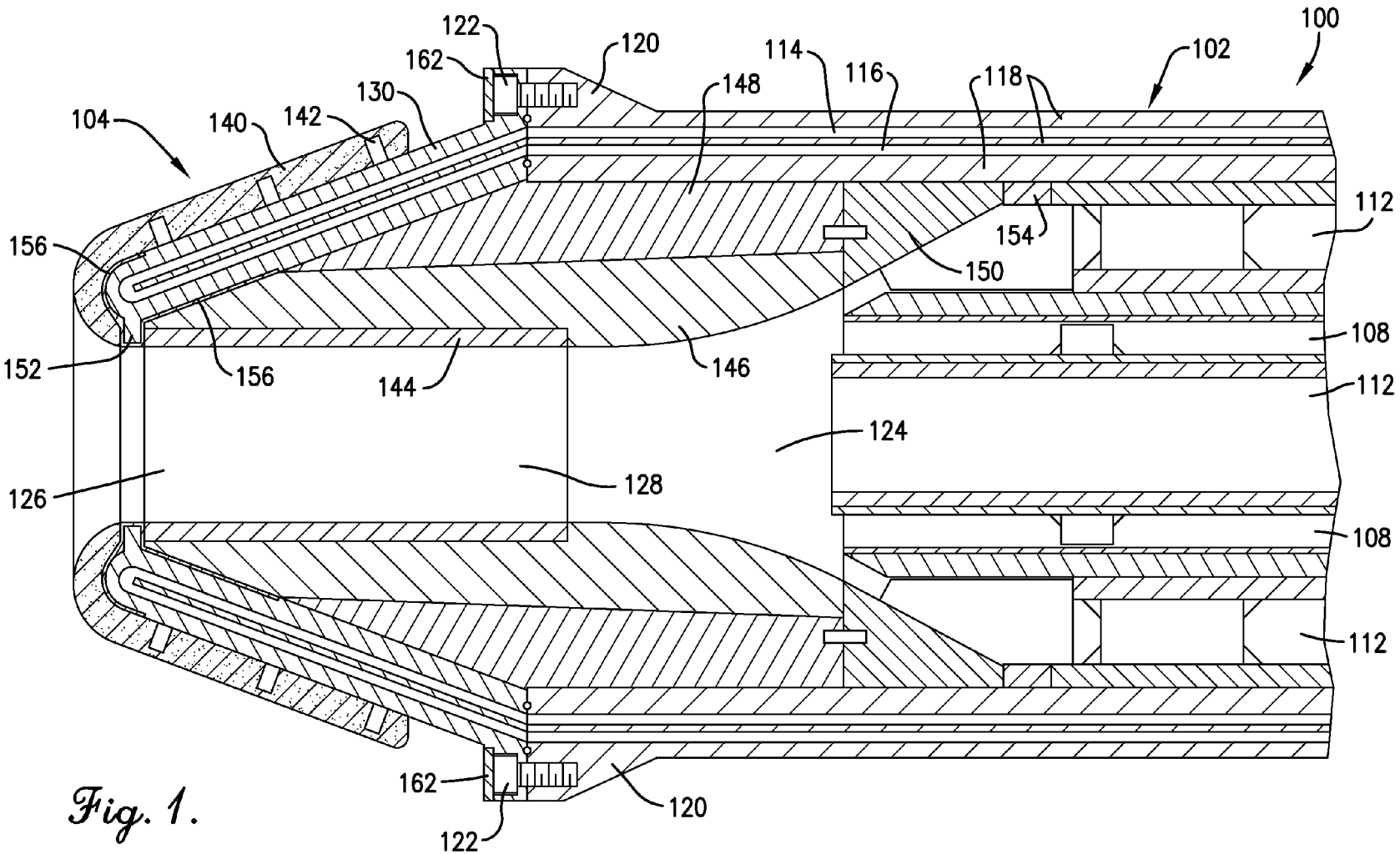
FIG. 1 is a side elevation cross-sectional view of a portion of a first burner including a detachable nozzle secured to a body of the burner via a plurality of bolts.
Figure 2:
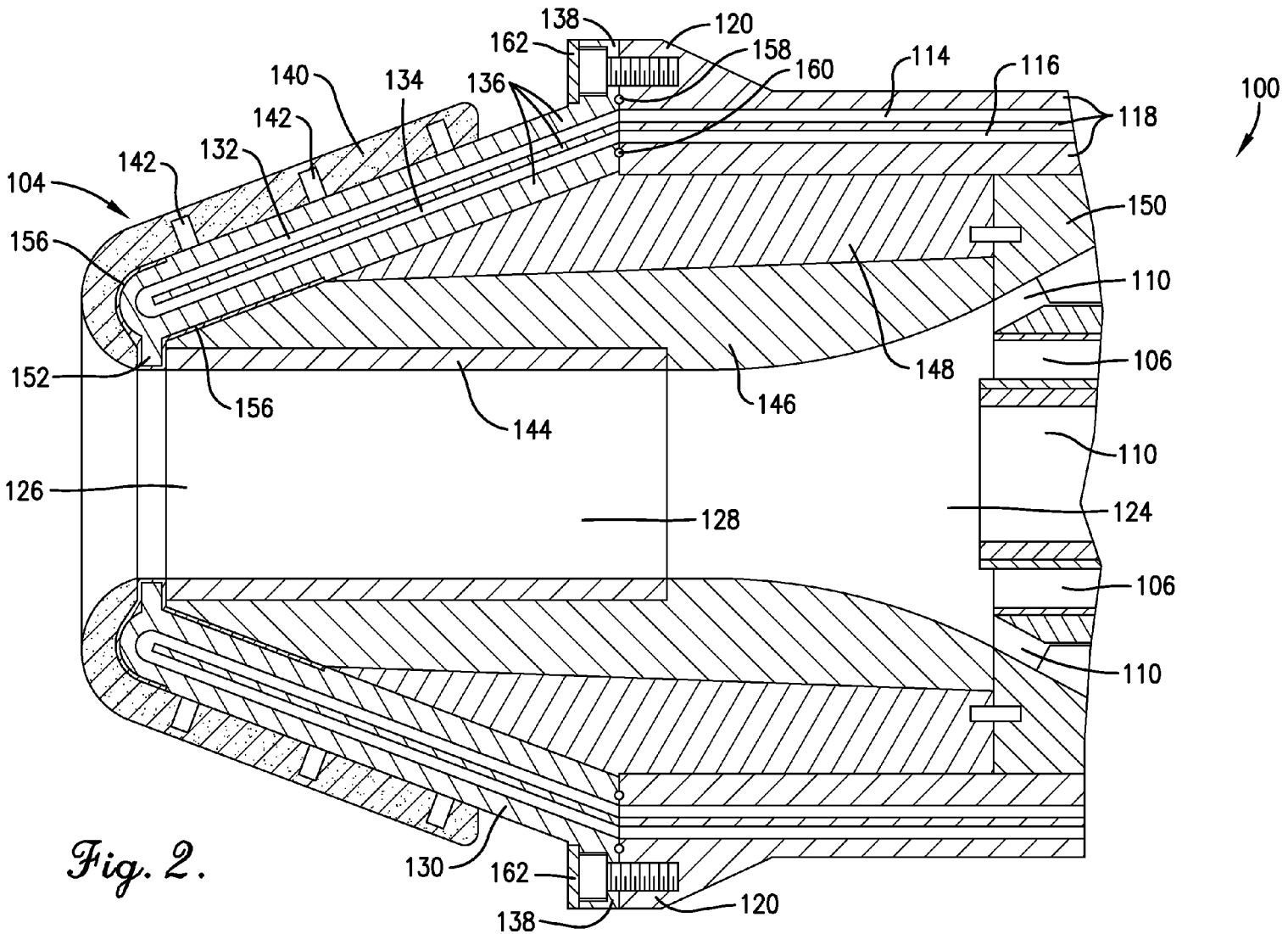
FIG. 2 is a side elevation cross-sectional view of the burner of FIG. 3, illustrating the nozzle in greater detail.

An improved burner constructed according to principles of the present technology is illustrated in FIGS. 1 and 2 and designated generally by the reference numeral 100. The burner 100 comprises a body 102 and a nozzle 104.

The body 102 comprises a feedstock inlet (not shown), a feedstock outlet 106, and a feedstock passage 108 operable to convey feedstock, such as a solid carbonaceous fuel in an aqueous slurry, from the feedstock inlet to the outlet 106. The feedstock passage 108 generally presents a ring-shaped cross section when viewed along a longitudinal axis (i.e., left to right in FIGS. 1 and 2).

The body 102 may further include an oxidant inlet (not shown), one or more oxidant outlets 110, and one or more oxidant passages 112 operable to convey an oxidant, such as oxygen or oxygen-enriched air, from the oxidant inlet to the outlet 110. A first one of the illustrated oxidant passages 112 surrounds the feedstock passage 108 and presents a ring-shaped cross section when viewed along a longitudinal axis, and a second one of the illustrated oxidant passages 112 passes through the feedstock passage and presents a circular cross section when viewed along a longitudinal axis.

The body 102 may further include a coolant inlet and a coolant outlet (neither shown) and first and second coolant conduits 114,116. The coolant conduits 114,116 are coaxially and concentrically located proximate a periphery of the body 102 such that the first conduit 114 is located radially outwardly relative to the second conduit 116. The conduits 114, 116 convey a coolant, such as water, through the body 102 to and from the nozzle 104. A plurality of coolant conduit walls 118 generally define the conduits 114,116 and may be thermally conductive. The coolant conduit walls 118 may include copper or other metal to enhance the thermal conductivity.

The body 102 further includes a flange 120 located proximate the nozzle 104 and extending radially outwardly from an outer surface of the body 102 and partially or completely circumscribing the body 102. The flange 120 includes one or more internally-threaded recesses for receiving a plurality of attachment elements, such as bolts 122, as explained below in greater detail. If the flange 120 includes multiple recesses, the recesses may be approximately equally circumferentially spaced. The flange 120 may be integrally formed with an outer one of the coolant conduit walls 118, as illustrated, or may be attached thereto by, for example, welding or other attachment means.

With reference particularly to FIG. 2, the nozzle 104 comprises an inlet 124, an outlet 126, a passage 128 from the inlet 124 to the outlet 128, and a cooling jacket 130. The inlet 124 is the point of entry of the oxidant and feedstock from the body 102, and thus generally corresponds to the feedstock outlet 106 and the oxidant outlet 110 of the body 102 such that there is fluid communication between the feedstock outlet 106 and the oxidant outlet 110 of the body 102 and the inlet 124 of the nozzle 104. Oxidant and feedstock exit the burner 100 via the nozzle 104 in a high velocity and/or atomized state to enter, for example, a reaction chamber of a gasifier.

The passage 128 conveys the oxidant and the feedstock from the inlet 124 to the outlet 126 where the oxidant and feedstock are discharged into, for example, a reaction chamber. The open area of the outlet 126 is generally smaller than the open area of the inlet 124. By way of example, if the inner surface of the passage 128 is tubular, the passage 128 narrows in diameter along at least a portion of a length thereof. As explained above, the narrowing passage 128 induces increased velocity, atomization, and mixing of the oxidant and the feedstock as it passes into the reaction chamber.

The cooling jacket 130 generally surrounds or circumscribes the nozzle 104 to cool various components of the nozzle 104 such as, for example, wear resistant and thermally resistant inserts, as explained below in greater detail. The cooling jacket comprises a first coolant conduit 132 and a second coolant conduit 134 generally defined by a plurality of coolant conduit walls 136. The nozzle 104 presents a generally frustoconical shape, and the coolant conduits 132,134 extend around a perimeter of the nozzle 104 and are coaxially and concentrically located.

The coolant conduits 114, 116 of the body 102 are in fluid communication with the coolant conduits 132, 134 of the nozzle 104. The first conduit 132 may receive a low temperature coolant from the first coolant conduit 114 of the body 102, for example, and convey the coolant to a point of the nozzle 104 proximate the outlet 126, where the coolant enters the second coolant conduit 134 and is ultimately discharged into the second coolant conduit 116 of the body 102. Thus, in this example, low temperature coolant enters the nozzle 104 from the body 102 via the first coolant conduit 132 and exits the nozzle 104 through the second coolant conduit 134 where the high temperature coolant is discharged back into the body 102.

The coolant conduit walls 136 are preferably relatively highly thermally conductive, and may be constructed of stainless steel or other metal. A diameter of the nozzle 104 at the larger end (proximate the body 102) may be, for example, within the range of from about four inches to about fourteen inches, within the range of from about six inches to about twelve inches, or within the range of from about eight inches to about ten inches. A diameter of the nozzle 104 at the smaller end may be, for example, within the range of from about two inches to about twelve inches, within the range of from about four inches to about ten inches, or within the range of from about six inches to about eight inches.

The nozzle 104 includes a flange 138 proximate the body 102. The flange 138 extends radially outwardly from an outer surface of the cooling jacket 130. The illustrated flange 138 includes a plurality of bolt-receiving through holes in register with the recesses of the flange 120 of the body 102 described above. Thus, the bolts 122 are inserted through the through holes of the flange 138 and threaded into the internally-threaded recesses of the flange 120, thereby securing the nozzle 104 to the body 102. As illustrated in the drawings, when the nozzle 104 is secured to the body 102, the flange 138 of the nozzle 104 is adjacent to the flange 120 of the body 102 and forms a substantially air-tight junction. The characteristics of the attachment elements 122 may vary from one implementation to another. By way of example, however, the attachment elements 122 may be three-eighths inch socket head cap screws.

The nozzle 104 further includes a castable refractory material 140 partially or entirely covering an outer surface of the cooling jacket 130. The castable refractory material 140 is secured in place by a plurality of attachment elements 142 secured to the cooling jacket 130. The attachment elements 142 may be, for example, ribbed metal studs one-fourth inch in diameter welded to the cooling jacket 130 with a stud welder, and may be made of 300 series stainless steel. The castable refractory material 140 may be approximately three-fourths inch to one inch thick.

The castable refractory material 140 is a moldable refractory material that may be applied to a mold or surface, such as the outer surface of the cooling jacket 130, in a moldable or wet state and then allowed to harden or set up. By way of example, the castable refractory material may be a plastic refractory.

The castable refractory material 140 retains its structural integrity even when exposed to high temperatures. In a first exemplary embodiment, the castable refractory material 140 withstands temperatures up to 1100° C. In a second exemplary embodiment, the castable refractory material 140 withstands temperatures up to 1400° C. In a third exemplary embodiment, the castable refractory material 140 withstands temperatures up to 1800° C.

Because the nozzle 104 is detachable from the body 102, the castable refractory material 140 may be applied to the nozzle 104 in a moldable or wet state and then cured in a heated chamber, such as an industrial use oven. Due to the size of the burner 100, the conventional curing process used for the castable refractory material involves exposure of the castable refractory material to an open flame, which is less desirable than curing the material 140 in a heated chamber.

The nozzle 104 may include one or more inserts 144, 146, 148, 150 defining an inner surface of the passage 128. Each of the inserts 144, 146, 148, 150 is generally tubular in shape and circumscribes at least a portion of the passage 128. Certain ones of the inserts 144, 146, 148, 150 may be wear resistant and/or thermally resistant, and other ones of the inserts 144, 146, 148, 150 may be thermally conductive to conduct heat away from the passage toward the coolant conduit walls 136.

In a first exemplary embodiment, a wear resistant material is a material with a Brinell hardness of 500 kg/mm$^2$. In a second exemplary embodiment, a wear resistant material is a material with a Brinell hardness of 700 kg/mm$^2$. In a third exemplary embodiment a wear resistant material is a material with a Brinell hardness of 900 kg/mm$^2$. In a first exemplary embodiment, a thermally conductive material is a material with a thermal conductivity greater than 100 W/(m×K). In a second exemplary embodiment, a thermally conductive material is a material with a thermal conductivity greater than 200 W/(m×K). In a third exemplary embodiment, a thermally conductive material is a material with a thermal conductivity greater than 300 W/(m×K). A thermally resistant material may be a material with a thermal conductivity less than any of the thermal conductivities set forth above as exemplary embodiments.

A first insert 144 includes wear resistant material such as, for example, tungsten carbide or silicon carbide. The inner diameter of the first insert 144 may be within the range of from about one inch to about three inches and, more particularly, may be about two inches. The first insert 144 is exposed to the high velocity stream of feedstock and oxidant mixture and is proximate the outlet 126 of the nozzle 104, and therefore is designed to withstand the stresses associated with exposure to this environment. A second insert 146 also includes a wear resistant material, such as tungsten carbide and/or silicon carbide.

A third insert 148 is interposed between the second insert 146 and the coolant conduit walls 136, and includes thermally conductive material for transferring heat from the second insert 146 to the coolant conduit walls 136. Because the third insert 148 is not exposed to the oxidant and feedstock mixture, it may have minimal wear resistance, and may be constructed in whole or in part of copper or other metal.

As best illustrated in FIG. 1, a fourth insert 150 is located upstream of the second and third inserts 146,148 and provides an inner surface defining a passage with an upstream opening that is larger than a downstream opening and that channels oxidant from the outermost oxidant passage 112 radially inwardly. Because the fourth insert 150 is in direct contact with the oxidant, the fourth insert 150 is preferably a material that resists degradation caused by exposure to the oxidant. By way of example, the fourth insert may be constructed of an alloy such as MONEL 400, 300 series stainless steel, or alloy 800.

A first insert stop 152 and a second insert stop 154 cooperate to secure in place the various inserts 144,146,148,150. The first insert stop 152 generally extends radially inwardly from the cooling jacket proximate the outlet 126, and may partially or completely encircle the passage 128. The second insert stop 154 generally extends radially inwardly from the coolant conduit walls 118 of the body 102 proximate the outlets 106,110, and may partially or completely encircle the outlets 106,110. A wear resistant overlay 156 covers an end of the cooling jacket 130, including the first insert stop 152, and provides a final barrier against wear when the castable refractory material 140 and the first and second inserts 144,146 are worn away to expose the cooling jacket 130 to the oxidant and feedstock stream and/or a reaction chamber of a gasifier.

The first insert stop 152 and the second insert stop 154 may be the only means of securing the various inserts 144, 146, 148, 150 in place, enabling a user to easily reuse one or more of the inserts 144, 146, 148, 150 when the nozzle 104 is replaced or repairs are otherwise made to the burner 100. When the nozzle 104 is replaced, for example, the first and second inserts 144, 146 may need to be replaced while the third and fourth inserts 148, 150 are in acceptable condition for further use.

A first o-ring 158 and a second o-ring 160 provide a seal between the body 102 and the nozzle 104 and prevent coolant from escaping the burner 100 when passing between the coolant conduits 114,116 of the body and the coolant conduits 132,134 of the nozzle 104. A protective cover 162 may also be placed on the nozzle 102 to shield the bolts 122 from dust, debris and other damaging elements of the environment. The illustrated cover 162 is substantially flat and ring-shaped, wholly or partially encircling the nozzle 104 and placed against the flange 138 of the nozzle 104.

Figure 3:
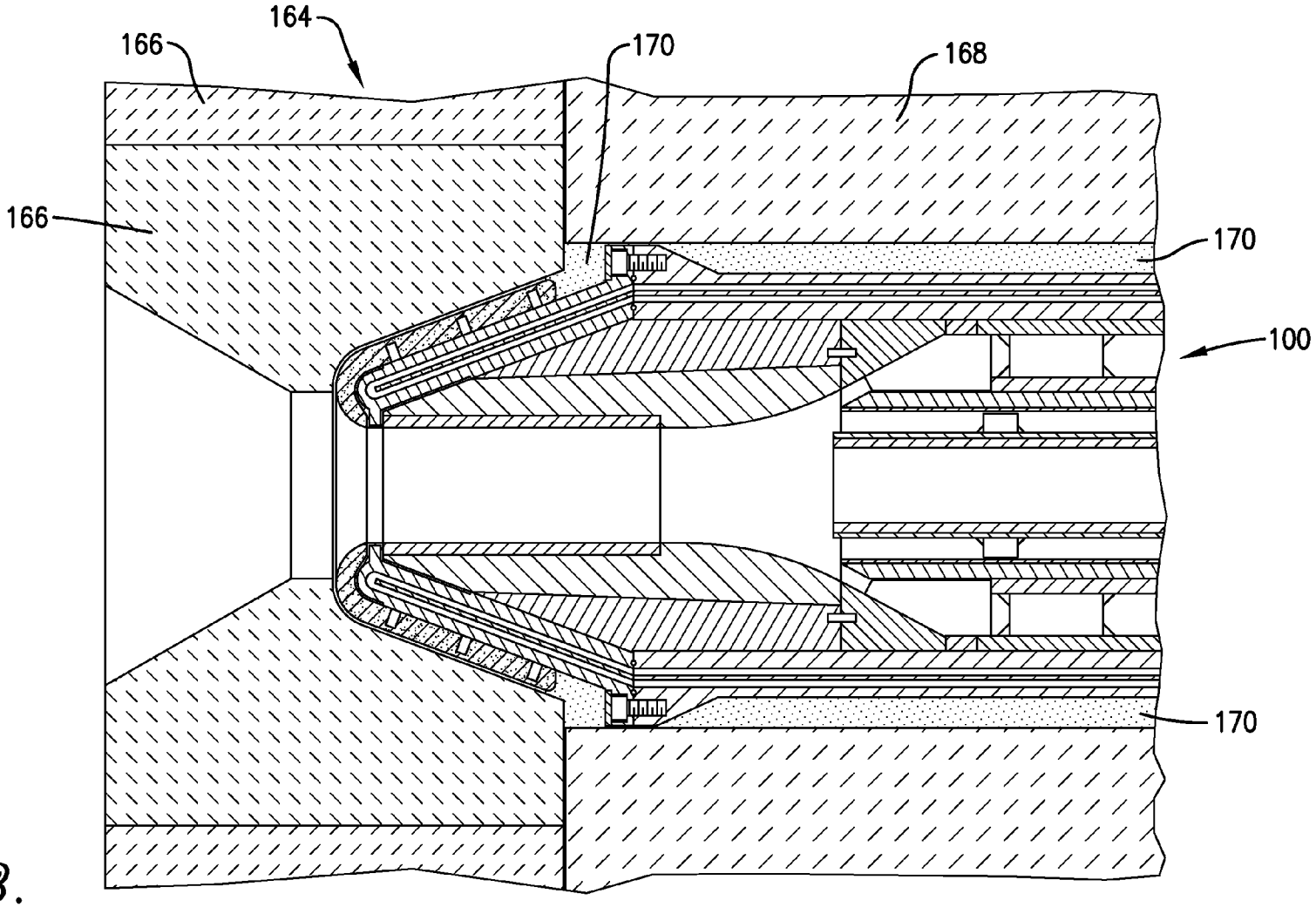
FIG. 3 illustrates the burner of FIG. 3 embedded in a gasifier.

An exemplary application of the burner 100 is illustrated in FIG. 3, where the burner 100 is shown as part of a gasification reactor 164. The reactor 164 is conventional and may include, for example, a plurality of hot-face refractory material 166, insulating fire brick 168, and a flexible insulating material 170, such as a ceramic fiber blanket or ceramic fiber paper including KAOWOOL, immediately surrounding the burner 100.

Figure 4:
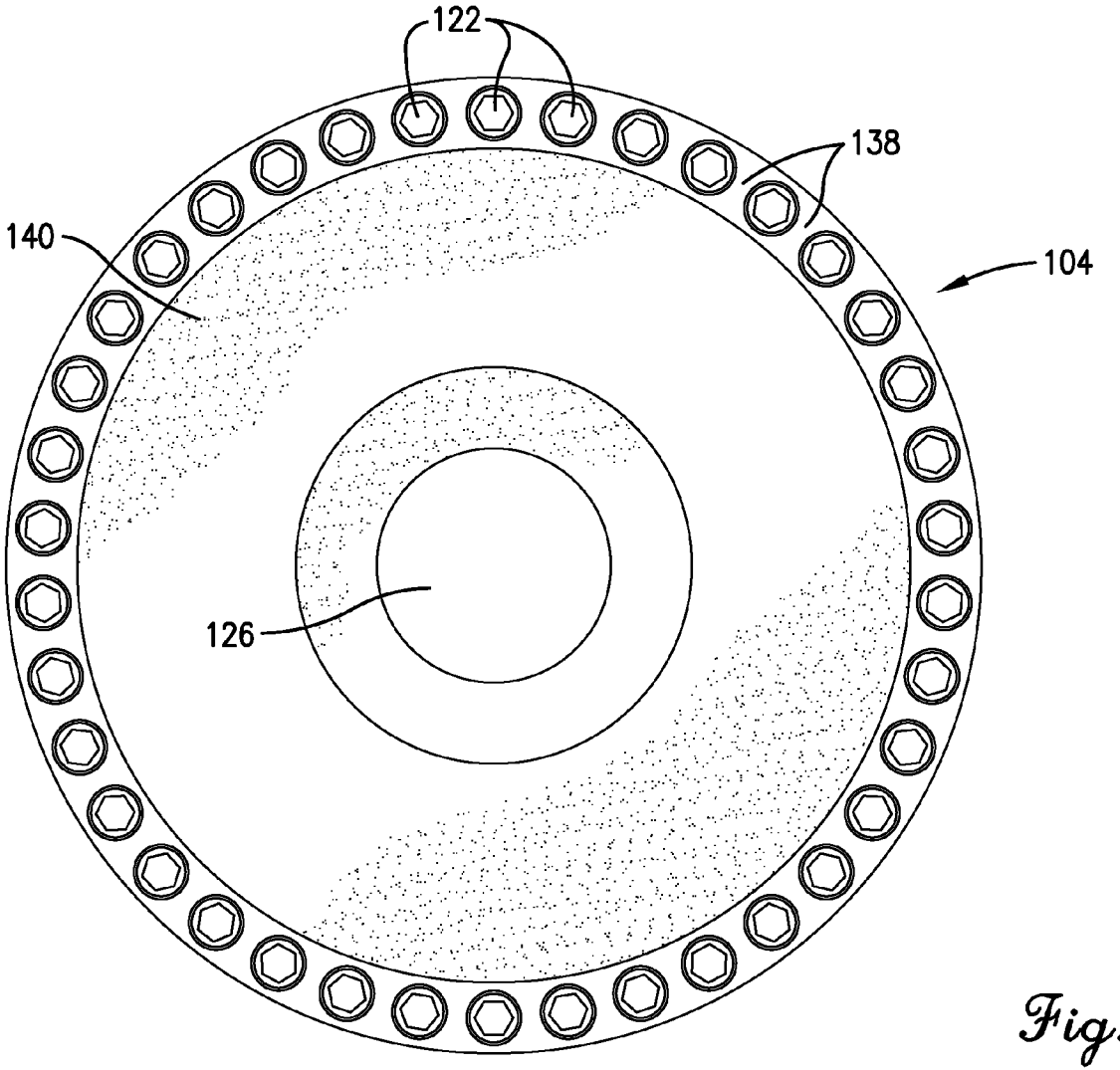
FIG. 4 is a front elevation view of the burner of FIG. 3.

A front elevation view of the nozzle 104 is illustrated in FIG. 4 without the cover 162. In this view, the flange 138 of the nozzle 104 is shown encircling the nozzle 104. A plurality of bolts 122 are placed in a configuration substantially encircling the nozzle 104.

As explained above in the section titled RELATED ART, the nozzle 104 may degrade to the point of failure before other parts of the burner 100. When this happens, the nozzle 104 may be replaced in a relatively quick process performed on-site. First, the burner 100 is decoupled from the gasification reactor or other system where it is applied. The original bolts 122 are then removed from the burner 100 in a conventional manner. With the bolts 122 removed, the nozzle 104 and one or more of the inserts 144,146,148,150 are decoupled from the body 102 of the burner 100. Any of the inserts 144,146, 148,150 that were removed are replaced with new inserts, and a new nozzle is aligned with the body 102 of the burner 100. The original bolts 122 or replacement bolts are then threaded into the new nozzle and the body 102, thereby coupling the new nozzle to the body 102 of the burner 100 and providing a refurbished burner. The refurbished burner is then coupled with the gasification reactor.

Figure 5:
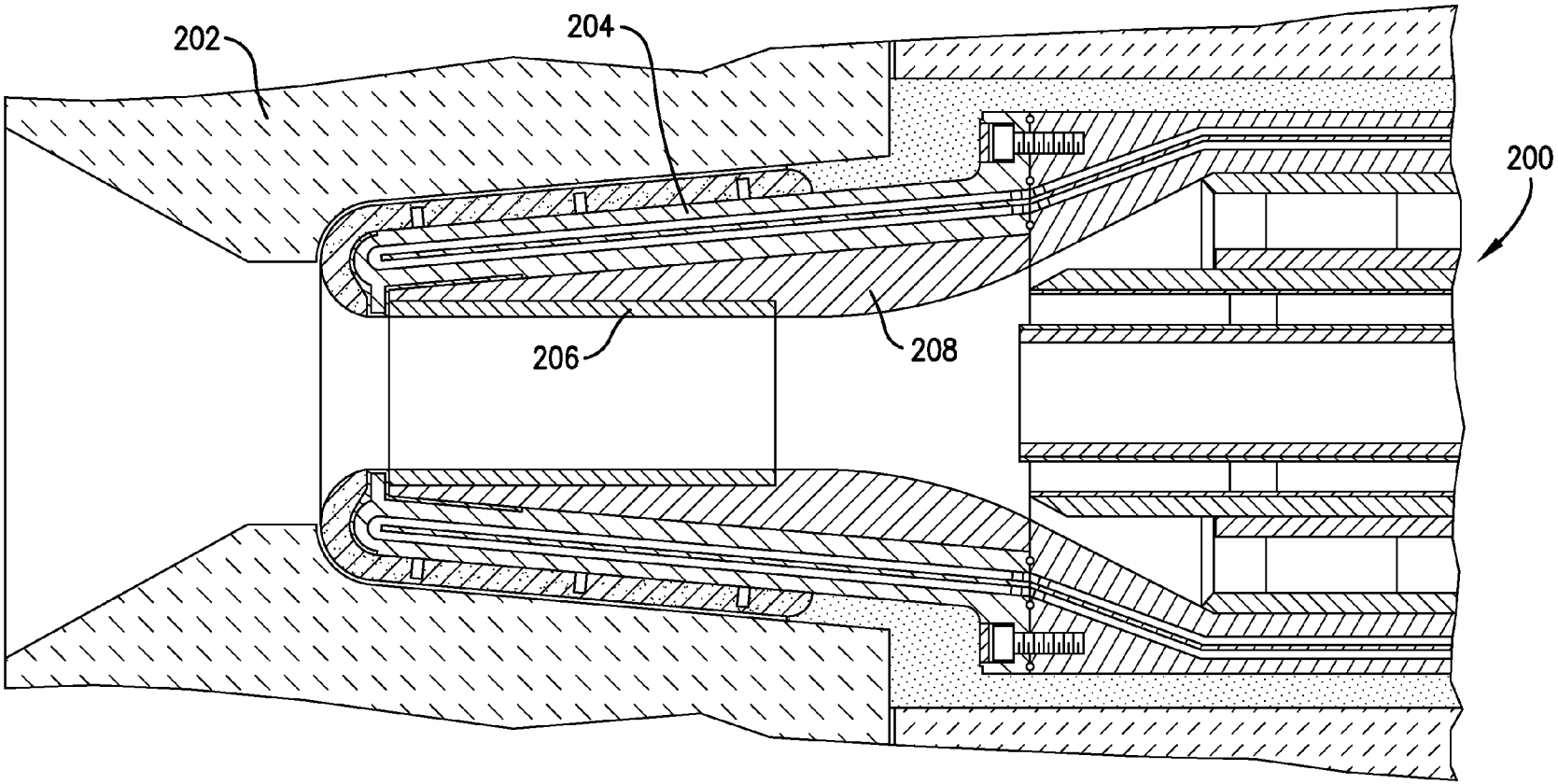
FIG. 5 is a side elevation cross-sectional view of a portion of a second burner including a detachable nozzle secured to a body of the burner via a plurality of bolts.

A burner constructed according to a first alternative implementation of the present technology is illustrated in FIG. 5 and designated generally by the reference numeral 200. The burner 200 is shown embedded in a gasifier 202 and is similar in many regards to the burner 100 described above, but presents a more gradually-sloping coolant jacket 204 and fewer inserts than the burner 100. The illustrated burner 200 includes only two inserts 206,208. The burner 200 may be preferred over the burner 100 in certain applications because it occupies a smaller area than the burner 100.

Figure 6:
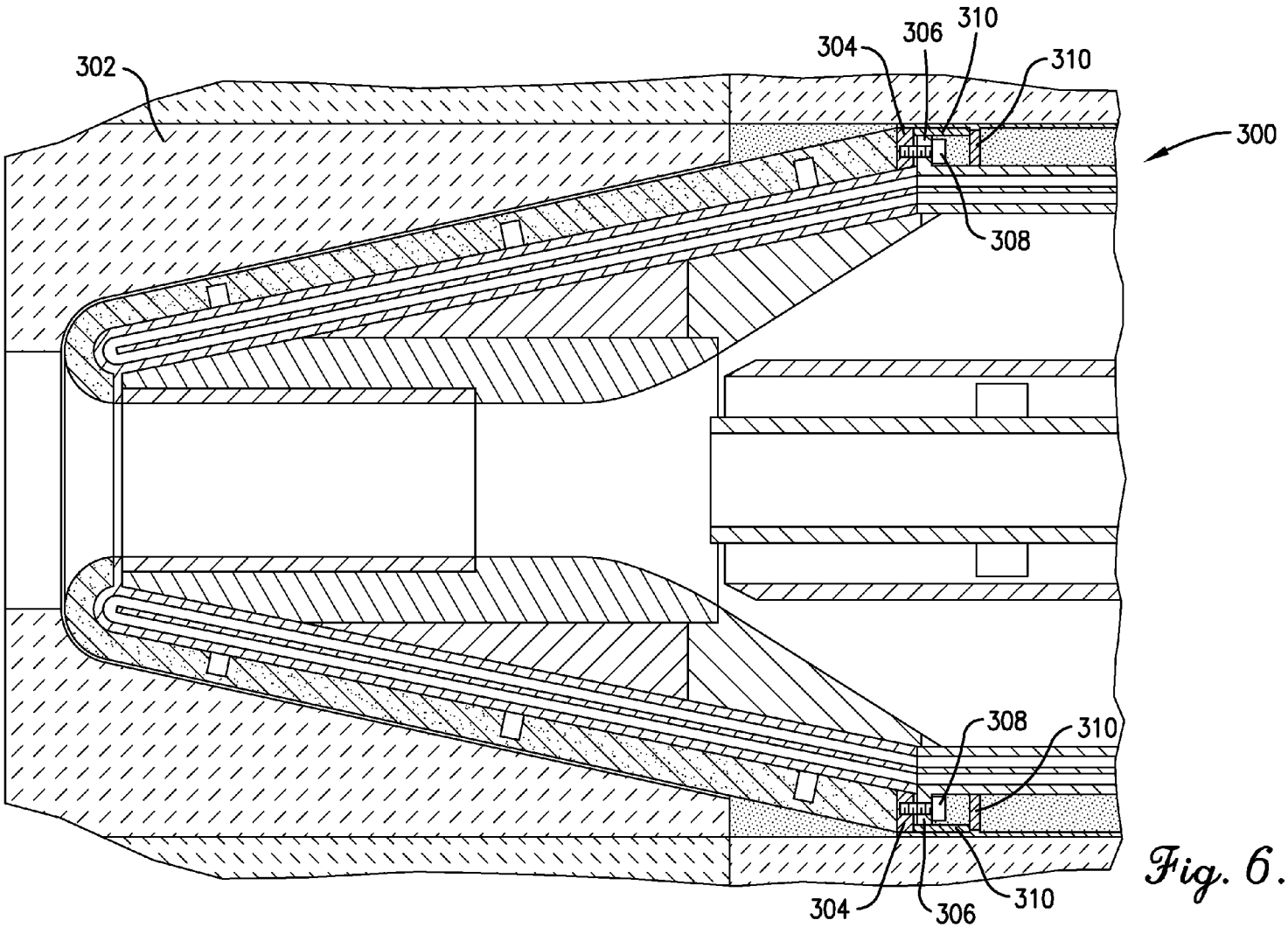
FIG. 6 is a side elevation cross-sectional view of a portion of a third burner including a detachable nozzle secured to a body of the burner via a plurality of bolts.

A burner constructed according to a second alternative implementation of the present technology is illustrated in FIG. 6 and designated generally by the reference numeral 300. The burner 300 is shown embedded in a gasifier 302 and is similar in many regards to the burner 100 described above. A first flange 304 associated with a nozzle of the burner 300 and a second flange 306 associated with a body of the burner 300 are configured such that the bolts 308 are inserted through the flange 306 of the body and into the flange 304 of the nozzle. Thus, the flange 304 of the nozzle includes a plurality of internally-threaded recesses while the flange 306 of the body includes a plurality of through holes.

The burner 300 further includes a cover 310 for shielding at least a portion of the each of the bolts 308. The cover 310 includes two elements that form a substantially 90° angle.

Figure 7:
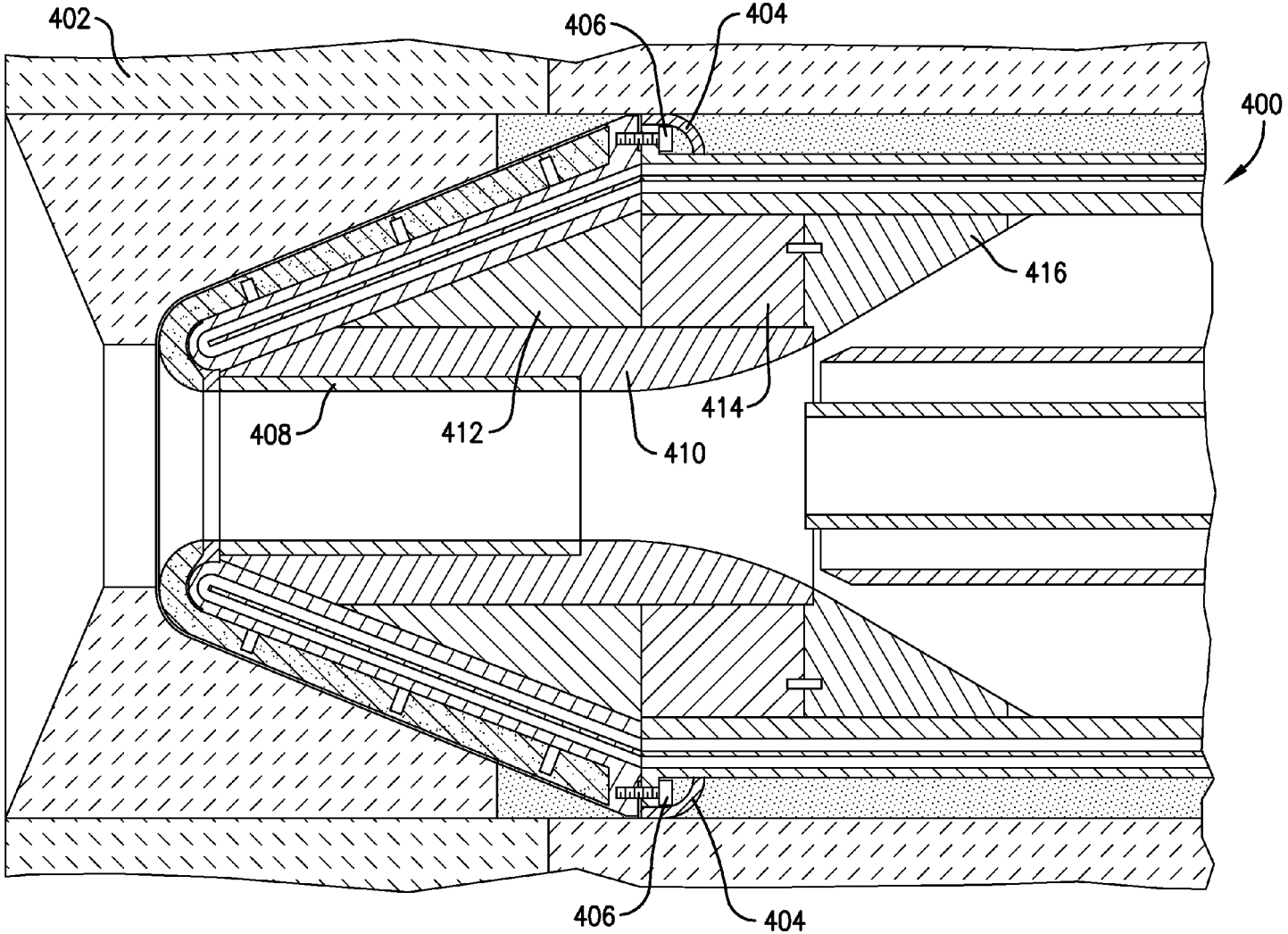
FIG. 7 is a side elevation cross-sectional view of a portion of a fourth burner including a detachable nozzle secured to a body of the burner via a plurality of bolts.

A burner constructed according to a third alternative implementation of the present technology is illustrated in FIG. 7 and designated generally by the reference numeral 400. The burner 400 is shown embedded in a gasifier 402 and is similar in many regards to the burner 300 described above, but includes a rounded cover 404 protecting at least a portion of each of the bolts 406. Furthermore, the burner 400 includes five inserts 408,410,412,414,416 instead of four.

Figure 8:
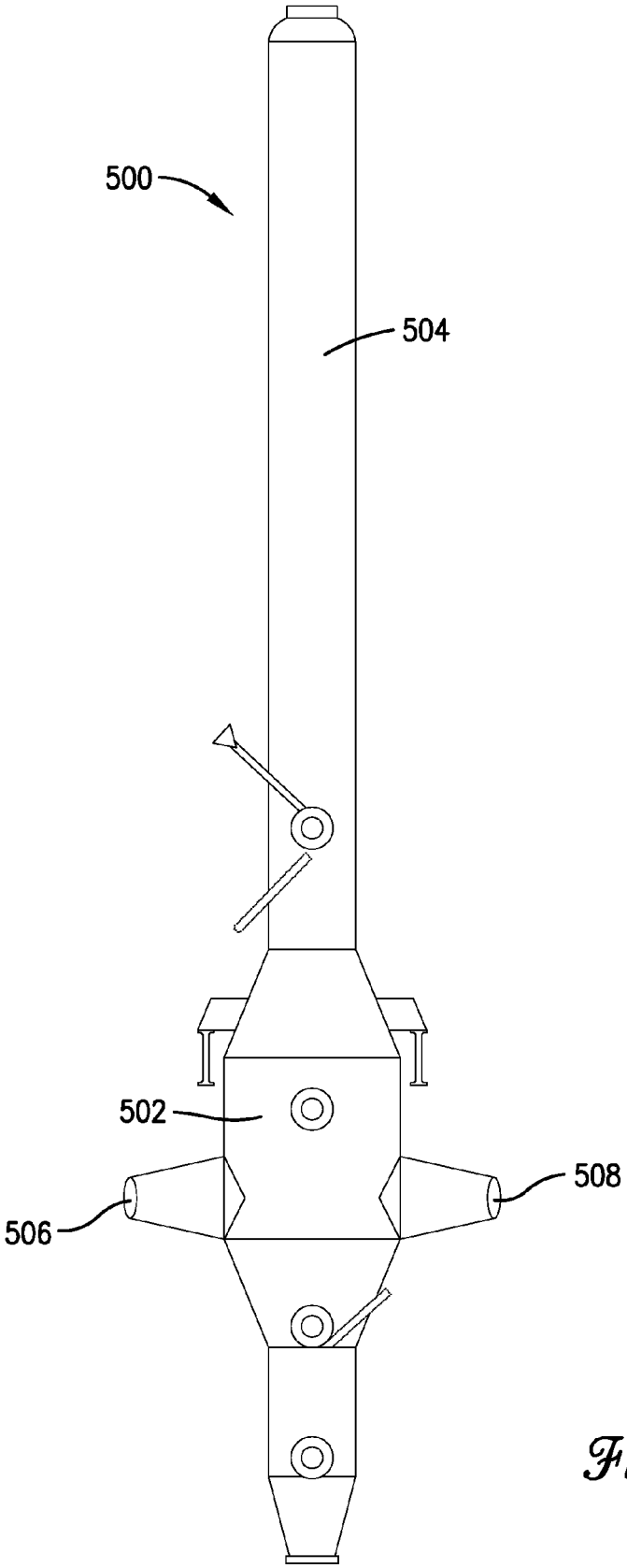
FIG. 8 is a side elevation view of an exemplary gasification reactor in which a burner constructed according to principles of the present technology may be applied.

Referring to FIG. 8, an exemplary application of any of the burners 100,200,300,400 is illustrated. FIG. 8 shows a gasification reactor 500 employed to convert generally solid feedstock into gaseous products. For example, the gasification reactor 500 may gasify carbonaceous feedstock, such as coal and/or petroleum coke, to produce desirable gaseous products such as hydrogen. The illustrated gasification reactor 500 is a two-stage gasification reactor system comprising a first stage reactor section 502 and a second stage reactor section 504. The first stage reactor section 502 defines a first reaction zone and comprises a plurality of inlets 506,508 operable to discharge the feedstock into the first reaction zone 502. The second stage reactor section 504 is positioned generally above the first stage reactor section 502 and defines a second reaction zone. Any of the burners 100,200,300,400 described above may be embedded in each of the inlets 506, 508.

Although the present technology has been described with reference to the preferred embodiments illustrated in the attached drawings, it is noted that equivalents may be employed and substitutions made herein without departing from the scope of the invention as recited in the claims.

As used herein, the terms "a", "an", "the", and "said" means one or more.

As used herein, the term "and/or", when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms "comprising", "comprises", and "comprise" are open-ended transition terms used to transition from a subject recited before the term to one or more elements recited after the term, where the element or elements listed after the transition term are not necessarily the only elements that make up the subject.

As used herein, the terms "containing", "contains", and "contain" have the same open-ended meaning as "comprising", "comprises", and "comprise", provided above.

As used herein, the terms "having", "has", and "have" have the same open-ended meaning as "comprising", "comprises", and "comprise", provided above.

As used herein, the terms "including", "includes", and "include" have the same open-ended meaning as "comprising", "comprises", and "comprise", provided above.

Having thus described preferred implementations of the present technology, what is claimed as new and desired to be protected by Letters Patent includes the following:

1. A gasification reactor system for gasifying a feedstock, said gasification reactor system comprising:

a first stage reactor section defining a first reaction zone, wherein said first stage reactor section comprises a plurality of inlets operable to discharge said feedstock into said reaction zone;

a burner disposed in each of said inlets, wherein each burner comprises a body defining an oxidant inlet, an uncombusted feedstock inlet, a body outlet, and one or more passages for conveying said oxidant from said oxidant inlet to said body outlet and for conveying said uncombusted gasification feedstock from said feedstock inlet to said body outlet, said body lacking an igniter for igniting the uncombusted gasification feedstock within the body;

a nozzle defining a nozzle inlet and a nozzle outlet, wherein said nozzle inlet is configured to receive said oxidant and said uncombusted gasification feedstock from said body outlet and said nozzle outlet is configured to discharge said oxidant and said uncombusted gasification feedstock into said gasification reactor;

a first flange extending radially outwardly from said body and a second flange extending radially outwardly from said nozzle;

at least one attachment component for removably securing said first flange and said second flange to one another such that said nozzle inlet is in fluid flow communication with said body outlet when said nozzle is attached to said body;

a first o-ring and a second o-ring for providing a substantially airtight junction between the first flange and the second flange when said flanges are removably secured to one another, wherein said airtight junction is suitable for use at the pressures and temperatures typically associated with the gasification of a carbonaceous feedstock without substantial leakage of the junction;

a second stage reactor section positioned generally above said first stage reactor section and defining a second reaction zone.

2. The gasification reactor system as set forth in claim 1, wherein said burner body further comprises a body coolant conduit and said burner nozzle further comprises a nozzle coolant conduit, wherein said body coolant conduit is in fluid flow communication with said nozzle coolant conduit when said nozzle is removably secured to said body.

3. The gasification reactor system as set forth in claim 2, further comprising a refractory material circumscribing at least a portion of the said coolant conduit of said burner nozzle.

4. The gasification reactor system as set forth in claim 1, wherein said nozzle further comprises a wear resistant material circumscribing at least a portion of said nozzle passage.

5. The gasification reactor system as set forth in claim 4, wherein said wear resistant material comprises tungsten carbide and/or silicone carbide.

6. The gasification reactor system as set forth in claim 4, wherein said nozzle further comprises a thermally conductive material circumscribing at least a portion of said wear resistant material.

7. The gasification reactor system as set forth in claim 6, wherein said burner further comprises a first insert stop proximate said nozzle outlet and a second insert stop proximate said body outlet, wherein said first insert stop and said second insert stop secure in place said wear resistant material and said thermally conductive material.

8. The gasification reactor system as set forth in claim 6, wherein said nozzle coolant conduit circumscribes said wear resistant material and said thermally conductive material.

9. The gasification reactor system as set forth in claim 1, wherein one of said first and second flanges includes one or more internally threaded bolt-receiving recesses, wherein the other of said first and second flanges includes one or more through-holes aligned with said internally threaded recesses.

10. The gasification reactor system as set forth in claim 9, wherein said at least one attachment component includes at least one bolt extending through one of said through-holes and threadedly engaging one of said bolt-receiving recesses.

11. The gasification reactor system as set forth in claim 10, further comprising a protective element for shielding a head of said at least one bolt.

12. The gasification reactor system as set forth in claim 1, wherein the inner diameter of said burner nozzle inlet is in the range of from about four inches to about fourteen inches, wherein the inner diameter of said burner nozzle outlet is in the range of from about two inches to about twelve inches.

13. A method of replacing a burner nozzle, said method comprising:

(a) providing the gasification reactor system of claim 1, comprising at least one burner, wherein each burner is disposed in an inlet;

(b) decoupling a burner from at least one of said inlets;

(c) detaching the burner nozzle from the burner body for each burner of part (b), wherein said detaching comprises removing said at least one attachment component that removably secures said burner nozzle to said burner body;

(d) removably securing a replacement burner nozzle to said burner body using said at least one attachment component, or at least one replacement attachment component, thereby providing a refurbished gasification burner; and (e) coupling said refurbished gasification burner to said gasification reactor system.

14. The method as set forth in claim 13, further comprising applying a castable refractory to the outer surface of said replacement burner nozzle and heating said nozzle with said castable refractory in a heated chamber to cure said castable refractory.

15. The method as set forth in claim 13, further comprising placing at least one tubular insert into said body against a stop ring before coupling said replacement burner nozzle with said burner body.

16. The method as set forth in claim 13, further comprising aligning at least one nozzle attachment opening of said replacement burner nozzle with at least one body attachment opening of said burner body prior to removably securing said replacement burner nozzle to said body, wherein said securing involves passing said at least one attachment component through at least one replacement nozzle attachment opening and at least one body attachment opening.

17. The method as set forth in claim 13, further comprising aligning a nozzle coolant conduit of said replacement burner nozzle with a body coolant conduit such that said nozzle coolant conduit is in fluid communication with said body coolant conduit when said replacement burner nozzle and said burner body are removably secured.

* * * * *